US005765826A

United States Patent [19]

Isoda et al.

[11] Patent Number: 5,765,826

[45] Date of Patent: Jun. 16, 1998

[54] SHEET SUPPLYING APPARATUS WITH PIVOTAL CONVEY UNIT

[75] Inventors: Yuzo Isoda, Yokohama; Jun Saito; Harukazu Sekiya, both of Kawasaki; Yasuhiro Uchida, Tokyo; Makoto Izumi, Yokohama; Takashi Kuwata, Kawasaki, all of Japan

[73] Assignee: Canon Kabushiki Kaisha, Tokyo, Japan

[21] Appl. No.: 915,929

[22] Filed: Aug. 21, 1997

Related U.S. Application Data

[63] Continuation of Ser. No. 552,108, Nov. 2, 1995, abandoned.

[30] Foreign Application Priority Data

| | | | |
|---|---|---|---|
| Nov. 7, 1994 | [JP] | Japan | 6-272315 |
| Jun. 9, 1995 | [JP] | Japan | 7-143031 |
| Sep. 28, 1995 | [JP] | Japan | 7-250339 |

[51] Int. Cl.[6] ..... B65H 1/00

[52] U.S. Cl. ..... 271/162; 271/9.11; 271/9.13; 271/272

[58] Field of Search ..... 271/9.11, 9.13, 271/162, 257, 256, 272–274

[56] References Cited

U.S. PATENT DOCUMENTS

| | | | |
|---|---|---|---|
| 4,124,204 | 11/1978 | VanBuskirk | 271/273 X |
| 4,953,846 | 9/1990 | Azeta et al. . | |
| 5,110,103 | 5/1992 | Miyoshi et al. | 271/275 X |
| 5,118,093 | 6/1992 | Makiura et al. | 271/273 X |
| 5,162,857 | 11/1992 | Higeta et al. . | |
| 5,201,518 | 4/1993 | Isoda . | |
| 5,230,503 | 7/1993 | Saito et al. . | |
| 5,240,238 | 8/1993 | Lee | 271/9.11 |
| 5,253,854 | 10/1993 | Tanoue et al. . | |

FOREIGN PATENT DOCUMENTS

| | | | |
|---|---|---|---|
| 64-75355 | 3/1989 | Japan . | |
| 192037 | 8/1991 | Japan | 271/9.11 |
| 195641 | 8/1991 | Japan | 271/9.11 |
| 293243 | 12/1991 | Japan | 271/273 |
| 7257 | 1/1992 | Japan | 271/273 |
| 208737 | 8/1993 | Japan | 271/273 |

*Primary Examiner*—Boris Milef

*Attorney, Agent, or Firm*—Fitzpatrick, Cella, Harper & Scinto

[57] ABSTRACT

The present invention provides a sheet supplying apparatus removably connected to an under side of an image forming apparatus to supply a sheet to the image forming apparatus. The apparatus has a main body connected to the under side of the image forming apparatus, a sheet supporting plate provided within the main body of sheet supplying apparatus to support a sheet, sheet supply rotary member for feeding out the sheet from the sheet supporting plate, a convey unit rotatably supported within the main body of sheet supplying apparatus to supply the sheet fed out by the sheet supply rotary member to a sheet receiving opening provided at a side surface of the image forming apparatus, and a positioning unit for positioning the convey unit in the vicinity of the sheet receiving opening.

11 Claims, 9 Drawing Sheets

SHEET SUPPLYING APPARATUS WITH PIVOTAL CONVEY UNIT

This application is a continuation of application Ser. No. 08/552,108, filed Nov. 2, 1995, now abandoned.

BACKGROUND OF THE INVENTION

1. Field of the Invention

The present invention relates to a sheet supplying apparatus for supplying a sheet to an image forming apparatus such as a printer, a facsimile machine, a copying machine and the like.

2. Related Background Art

Processing speed, in image forming apparatuses such as laser printers has been increased and the frequency of use of the apparatus under the network environment has also been increased, thereby leaving high speed and large quality treatment in great demand. In sheet supplying apparatuses used with the image forming apparatus, demand for large quality treatment and high reliability for supplying sheets has also increased. To satisfy such requirements, increases in the amount of sheets to be supplied, have been made by techniques in which cassette feeders or sheet supply decks can be added as an option.

Such a technique for increasing the number of the sheet supply decks is disclosed, for example, in the Japanese Patent Application Laid-Open No. 64-75355, which teaches a technique in which a sheet supply portion including a sheet supply cassette is-attached to a printer as option. Briefly explaining such a technique with reference to FIGS. 8 and 9, a lower sheet supply portion 102 including a sheet supply cassette 101 is connected to a lower portion of a printer 100 as option. Further, an intermediate convey portion 103 for convey a sheet fed from the sheet supply cassette 101 of the lower sheet supply portion 102 to an image forming portion of the printer 100 is provided at one side of the printer 100 and the lower sheet supply portion 102. The intermediate convey portion 103 comprises a frame 105 rotatably supported on a support shaft 104 of the lower sheet supply portion 102, guides 106, 107, 108 provided within the frame 105 and adapted to convey the sheet, and a pair of convey rollers 109.

As shown in FIG. 9, the intermediate convey portion 103 is secured to the printer 100 by engaging a pawl portion 111*a* of a lock lever 111 rotatably supported with respect to the frame 105 with a stopper 112 secured to the lower sheet supply portion 102. Further, when the pawl portion 111*a* is disengaged from the stopper 112 by rotating the lock lever 111 in a direction shown by the arrow g (FIG. 9), the frame 105 can be rotated with respect to the printer 100, thereby permitting the sheet jam treatment.

However, in the above-mentioned conventional sheet supplying apparatus, there arose the following problem. That is to say, since the intermediate convey portion 103 is secured to the printer by engaging the pawl portion 111*a* of the lock lever 111 rotatably supported with respect to the frame 105 with the stopper 112 secured to the lower sheet supply portion 102, the intermediate convey portion 103 is positioned with respect to the lower sheet supply portion 102.

Accordingly, at the junction between the intermediate convey portion 103 and the printer 100, if the sheet guides 106, 108 of the intermediate convey portion 103 are not aligned with sheet guides 113, 114 of the printer 100, poor sheet conveyance will occur.

In particular, if the lower sheet supply portion 102 is connected to the printer 100 with deviation in a left-and-right direction (FIGS. 8 and 9), the intermediate convey portion 103 will interfere with the printer 100, with the result that the pawl portion 111*a* of the lock lever 111 cannot be engaged by the stopper 112 or a sheet discharge opening of the intermediate convey portion 103 is deviated from a sheet receiving opening of the printer 100 to cause the poor sheet supply.

In order to solve the above-mentioned problem, it is necessary to improve the accuracy for positioning the lower sheet supply portion 102 with respect to the printer 100. However, when such accuracy is improved, a mechanism for connecting the lower sheet supply portion to the printer becomes more complex, or assembling workability is worsened.

SUMMARY OF THE INVENTION

The present invention aims to eliminate the above-mentioned conventional drawbacks, and an object of the present invention is to provide a sheet supplying apparatus and an image forming apparatus having such a sheet supplying apparatus, in which a sheet can smoothly be sent from an intermediate convey portion to the image forming apparatus with a simple construction.

According to the present invention, there is provided a sheet supplying apparatus connected to an image forming apparatus and adapted to supply a sheet to the image forming apparatus, which sheet supplying apparatus comprises a body disposed below the image forming apparatus, a sheet supporting means provided within the body and adapted to support sheet or sheets, a sheet supply means for feeding out the sheet from the sheet supporting means, a convey unit rotatably supported within the body and adapted to supply the sheet fed out by the sheet supply means to a sheet receiving opening provided at a side of the image forming apparatus, and a positioning means for positioning the convey unit in the proximity of the sheet receiving opening.

Further, according to the present invention, there is provided a sheet supplying apparatus removably connected to a lower portion of an image forming apparatus and adapted to supply a sheet to the image forming apparatus, which sheet supplying apparatus comprises a body connected to the lower portion of the image forming apparatus, a sheet supporting means provided within the body and adapted to support sheet or sheets, a sheet supply means for feeding out the sheet from the sheet supporting means, a convey unit rotatably supported within the body and adapted to supply the sheet fed out by the sheet supply means to a sheet receiving opening provided at a side of the image forming apparatus, and a biasing means for biasing the convey unit toward the side of the image forming apparatus.

In the present invention, since the convey unit is positioned in the proximity of the sheet receiving opening by means of the positioning means, if the connecting portion between the image forming apparatus and the body of the sheet supplying apparatus is deviated more or less, the positional relation between the convey unit and the sheet receiving opening is not so greatly deviated. Thus, the smooth sheet supply is ensured. In this way, occurrences of the poor conveyance of the sheet supplied from the sheet supporting means to the image forming apparatus through the convey unit can be reduced.

When the positioning is effected by biasing the convey unit by means of the biasing means to abut the protruded positioning member against the side of the image forming apparatus, the convey unit can easily be set and positioned.

Further, after the sheet supplying apparatus is connected to the image forming apparatus, even if the sheet supplying apparatus is deviated relative to the image forming apparatus, since the convey unit is not fixed to the image forming apparatus, deformation and/or damage can be prevented.

DETAILED DESCRIPTION OF THE PREFERRED EMBODIMENTS

Figure 1:
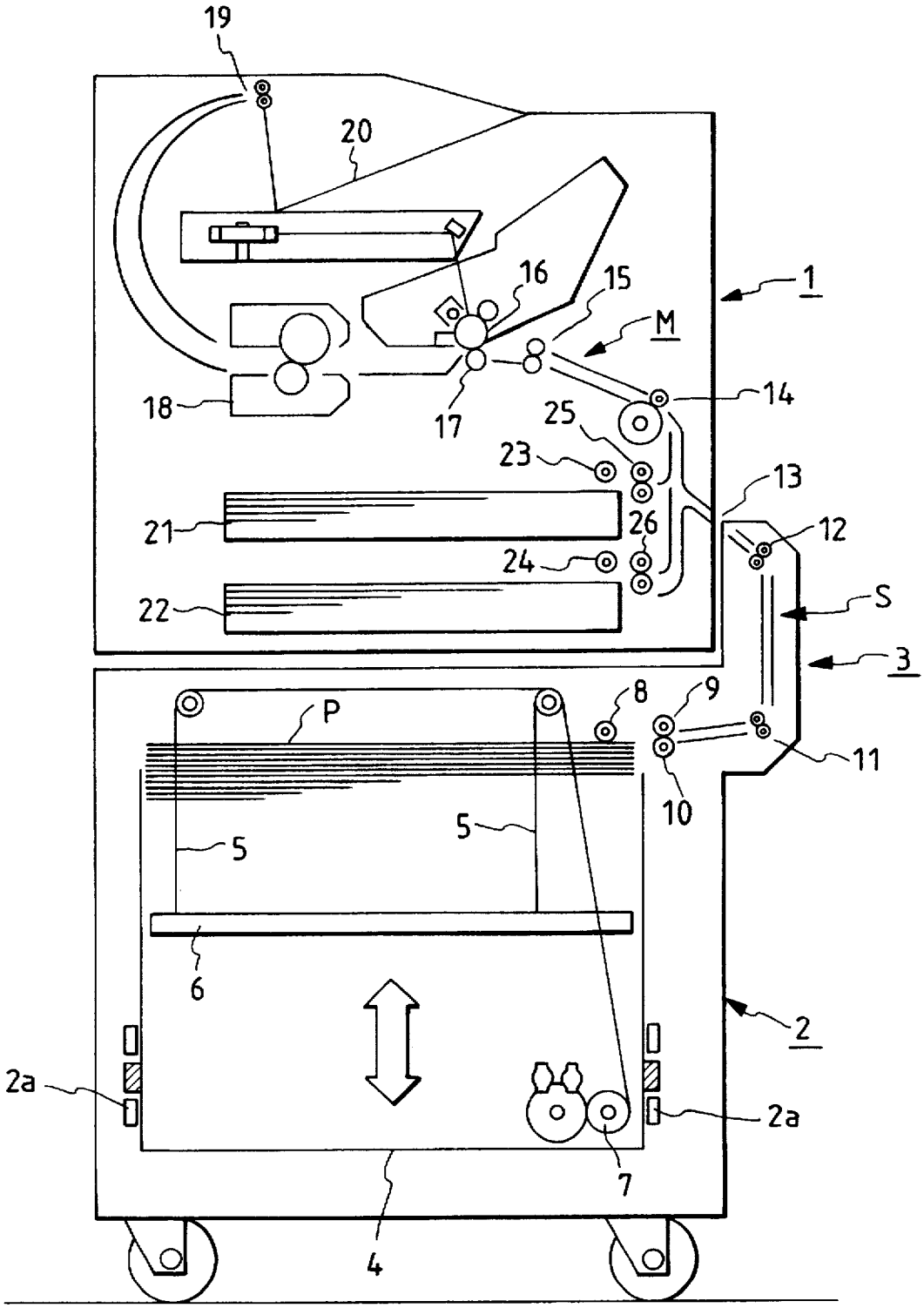
FIG. 1 is an elevational sectional view showing a condition that a sheet supplying apparatus according to the present invention is assembled to an image forming apparatus.
Figure 2:
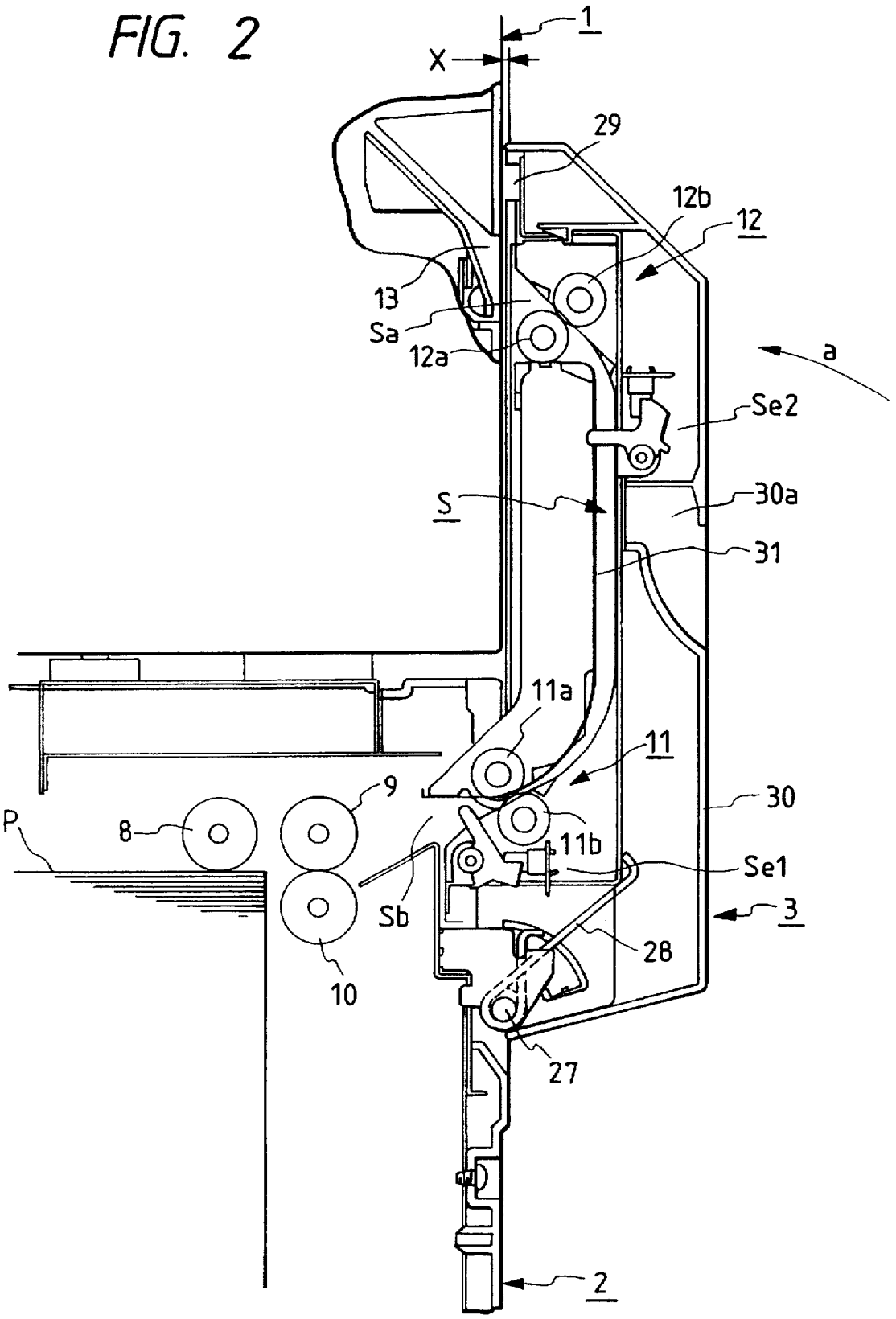
FIG. 2 is a sectional view of a convey unit for conveying a sheet from the sheet supplying apparatus of FIG. 1 to the image forming apparatus.
Figure 3:
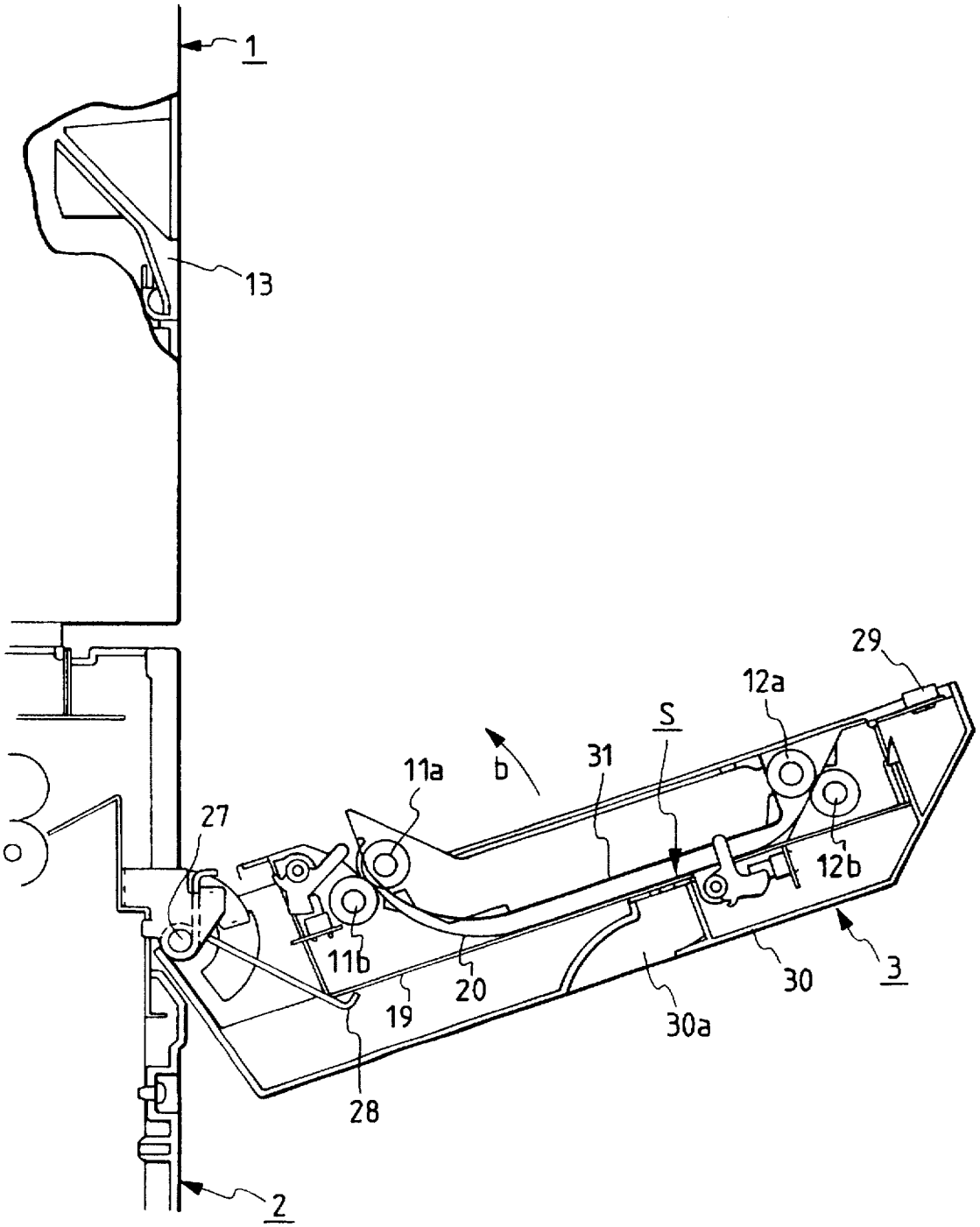
FIG. 3 is an explanatory view showing a condition that the convey unit of FIG. 2 is separated from a side of the image forming apparatus.
Figure 4:
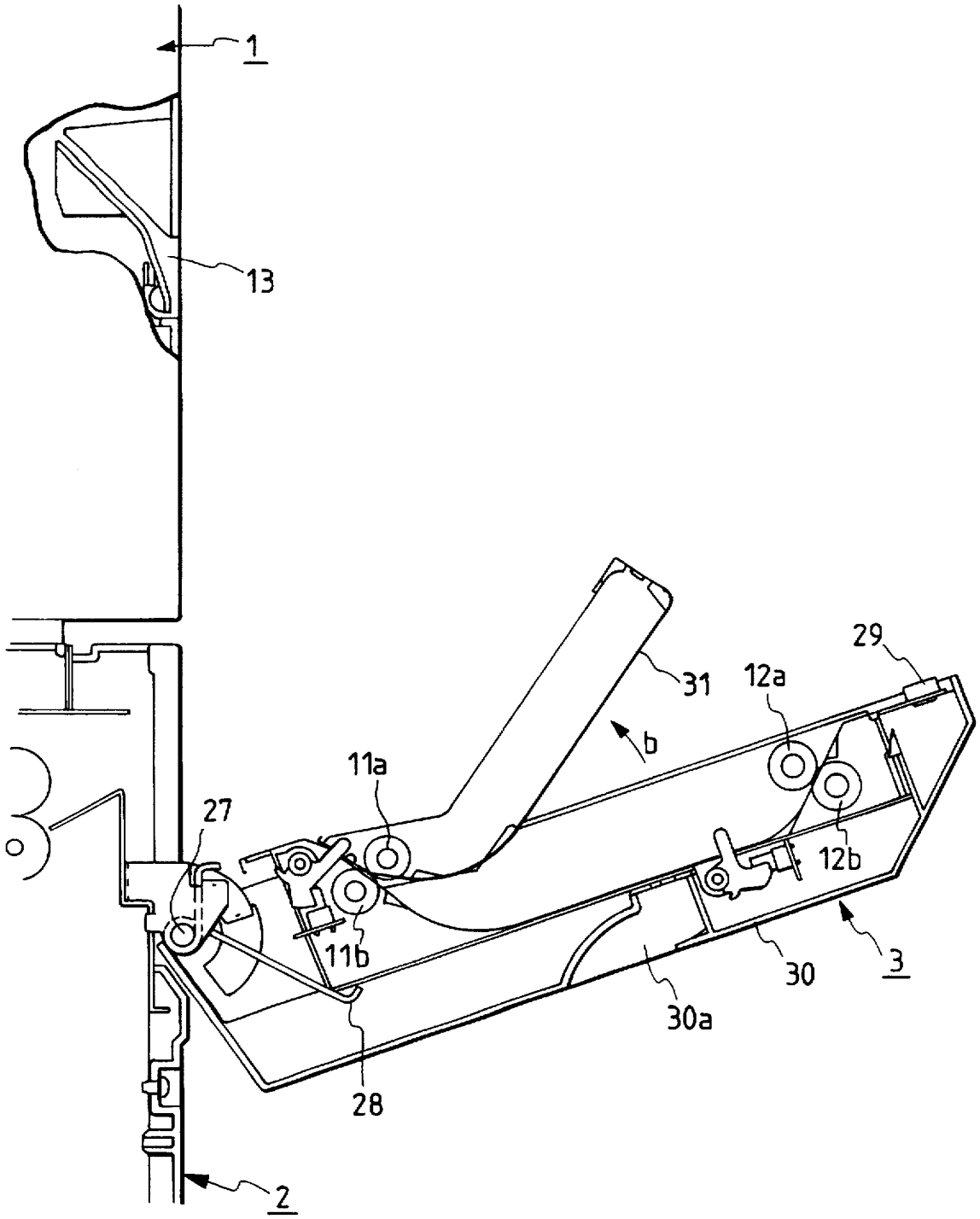
FIG. 4 is an explanatory view showing the convey unit of FIG. 3 in a condition that a guide is opened to effect sheet jam treatment.

A sheet supplying apparatus and an image forming apparatus according to a first embodiment of the present invention will be fully explained with reference to FIGS. 1 to 6. FIG. 1 is a sectional view of a sheet supplying apparatus according to the first embodiment of the present invention in which a sheet supply deck is disposed below an image forming apparatus. FIG. 2 is a sectional view showing a condition in which a convey unit is cocked or closed. FIG. 3 is a sectional view showing a condition in which the convey unit is opened. FIG. 4 is a sectional view showing a condition where an inner convey guide is released from the convey unit, and FIGS. 5 and 6.are explanatory views showing a gear train for transmitting a driving force to the convey unit.

In FIGS. 1 to 6, an electrophotographic image forming apparatus (referred to merely as "image forming apparatus" hereinafter) 1 comprises an image forming portion (image forming means), and a main sheet convey path M including convey rollers and convey guides (sheet convey means) for conveying a sheet (paper sheet, synthetic resin sheet or the like) P to the image forming portion. A sheet supply deck 2 is a sheet supplying apparatus added to the image forming apparatus 1, and a convey unit 3 has an auxiliary sheet convey path S for directing the sheet P supplied from the sheet supply deck 2 to the main sheet convey path M of the image forming apparatus 1.

Within the sheet supply deck 2, there is provided a sheet receiving container 4 which can be retracted from the sheet supply deck 2 toward this side (perpendicular to the plane of FIG. 1) along guides 2*a*. Within the sheet receiving container 4, there is provided a sheet stacking plate (sheet supporting means) 6 which can be lifted and lowered by means of wires 5 engaged by pulleys disposed at predetermined positions.

The sheet stacking plate 6 and the sheets P rested on the sheet stacking plate are lifted or lowered when the wires are wound around or unwound from a wire take-up shaft 7, and the sheet stacking plate is controlled by a sheet surface detection means (not shown) so that a height of an upper surface of the sheet stack is kept at a substantially constant level where the upper surface is contacted with a sheet supply roller (sheet supply means) 8. When the sheet supply roller 8 is rotated, the sheet P contacted with the sheet supply roller 8 is fed to a feed roller (sheet supply means) 9. The sheets is separated one by one by means of the feed roller 9 and a retard roller (sheet supply means) 10 to prevent the double-feed of sheets. This separating fashion is a conventional friction-retard separating fashion.

The separated sheet P is conveyed upwardly in a vertical direction by means of pairs of convey rollers 11, 12 included in the auxiliary sheet convey path S of the convey unit 3 and then is entered into the main sheet convey path M of the image forming apparatus through a sheet receiving opening 13. Thereafter, the sheet is conveyed to the image forming portion by means of convey rollers 14 and regist rollers 15 included in the main sheet convey path M. In the image forming portion, a toner image formed on an electrophotographic photosensitive drum 16 is transferred onto the sheet P by means of a transfer roller 17. Then, the sheet is sent to a fixing device 18, where the toner image is permanently fixed to the sheet P. Thereafter, the sheet P is discharged onto a discharge tray 20 by means of discharge rollers 19.

In FIGS. 1 to 6, the reference numerals 21, 22 denote sheet cassettes provided within the image forming apparatus 1; 23, 24 denote sheet supply rollers for supplying sheets from the sheet cassettes 21, 22; and 25, 26 denote pairs of separation rollers for separating the sheets supplied from the sheet cassettes 21, 22 one by one and for supplying the separated sheets to the main sheet convey path M. The pair of separation rollers 25, 26 may be of friction-retard type same as the feed roller 9 and the retard roller 10 of the sheet supply deck 2.

Next, the convey unit 3 will be fully described with reference to FIG. 2. A lower portion of the convey unit 3 is rotatably supported on a hinge shaft 27 provided on the sheet supply deck 2 so that the convey unit 3 can be rocked with respect to the sheet supply deck 2 around the hinge shaft 27.

Further, a torsion coil spring (biasing means) 28 is mounted on the hinge shaft 27 and has one end engaged by the sheet supply deck 2 and the other end engaged by the convey unit 3. The convey unit 3 is always biased toward a direction shown by the arrow a (FIG. 2) by a biasing force of the torsion coil spring 28, so that the convey unit 3 can be maintained in a cocked condition along a side surface of the image forming apparatus 1. When there is no image forming apparatus 1, the convey unit 3 is further rotated in the direction a to abut against a stopper (not shown). Incidentally, the biasing means may be a coil spring, a leaf spring or the like in place of the torsional coil spring 28.

A protruded positioning member (positioning means) 29 made of rubber, synthetic resin or the like is attached to an upper end portion of the convey unit 3 shown in FIG. 2. The positioning member 29 serves to effect the positioning of the convey unit 3 and prevent the damage (due to the shock) and noise when the convey unit 3 abuts against the side surface of the image forming apparatus 1 (cocked condition).

By maintaining the convey unit 3 in the cocked condition by using the positioning member 29, a sheet discharge opening Sa of the auxiliary sheet convey path S is aligned with the sheet receiving opening 13 to connect the auxiliary sheet convey path S to the main sheet convey path M and a sheet receiving opening Sb of the auxiliary sheet convey path S is connected to the sheet supply means including the feed roller 9, retard roller 10 and convey guides of the sheet supply deck 2, with the result that the sheet P can be supplied from the sheet supply deck 2 to the image forming portion of the image forming apparatus 1.

Since the positioning member 29 is disposed.at a position near the sheet discharge opening Sa and remote from the hinge shaft 27 around which the convey unit 3 is rotated, even if the image forming apparatus 1 is deviated in a left-and-right direction (FIG. 2) more or less, a distance X (FIG. 2) is kept substantially constant, thereby eliminating the poor conveyance of the sheet. The convey unit 3 can be separated from the side of the image forming apparatus 1 by pulling a gripper portion 30*a* formed on a unit cover 30 in a direction opposite to the direction a so that the convey unit 3 can be opened at a predetermined angle as shown in FIG. 3.

In the case, although the moment of the torsion coil spring 28 in the direction a is increased, since the gravitational weight of the convey unit 3 itself is also increased due to the shifting of the center of gravity of the convey unit, the convey unit 3 is maintained in the condition shown in FIG. 3 where the elastic force of the torsion coil spring 28 is balanced with the force obtained by the weight of the convey unit 3.

An inner convey guide 31 provided within the convey unit 3 is mounted on a roller shaft of a roller 11*a* (this roller cooperates with a roller 11*a* to constitute the pair of convey rollers 11) so that, as shown in FIG. 4, the inner convey guide can be opened by a predetermined angle by rotating the guide with respect to the convey unit 3 in a direction shown by the arrow b (FIG. 3). Accordingly, after the convey unit 3 is separated from the side of the image forming apparatus 1, when the inner convey guide 31 is released from the convey unit 3, the jammed sheet P can be easily removed. Incidentally, the auxiliary sheet convey path S includes sensors Se1, Se2 to detect the jam of the sheet P.

Figure 5:
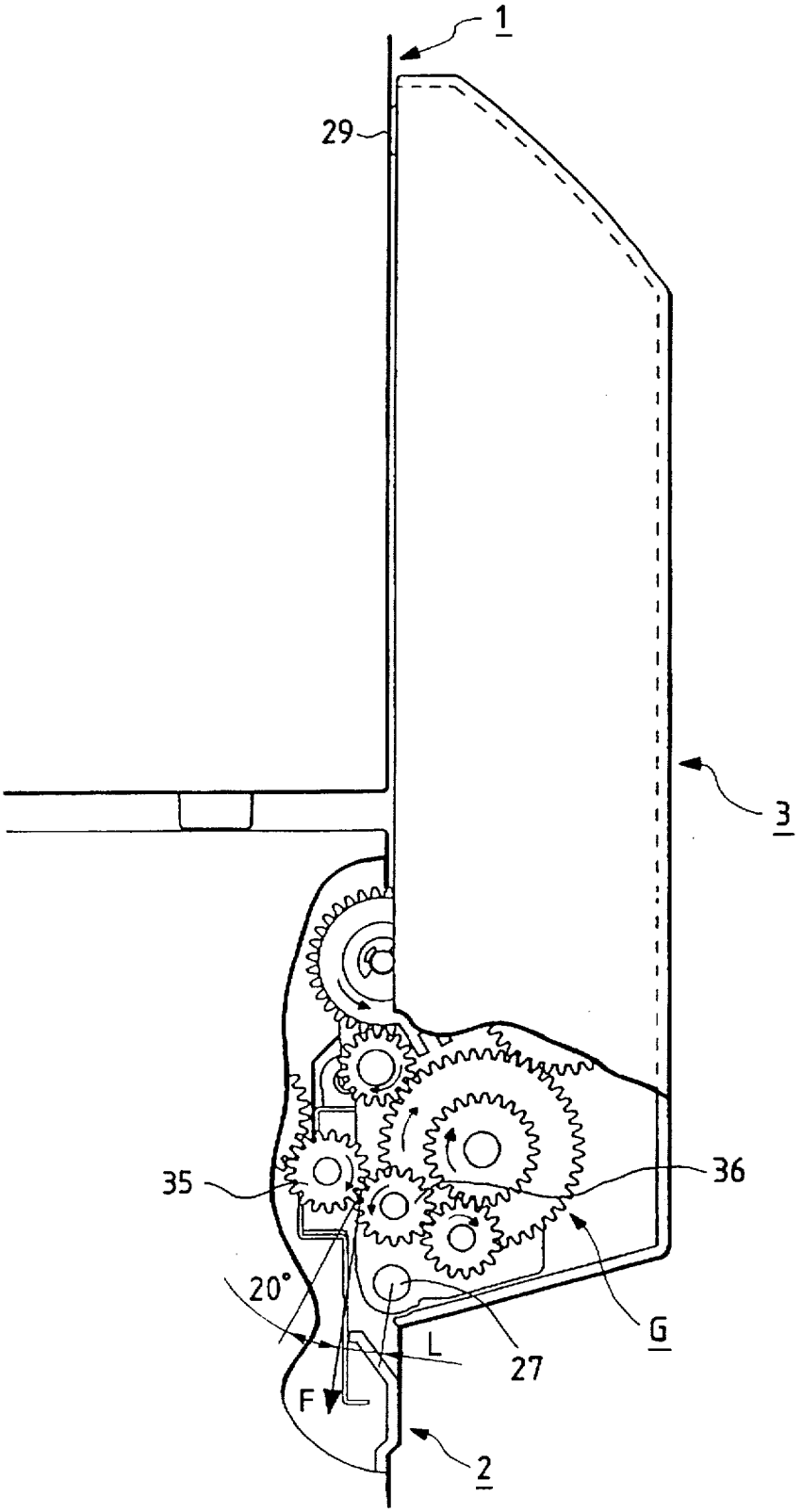
FIG. 5 is an explanatory view showing a gear train for transmitting a driving force to the convey unit.

As shown in FIG. 5, a driving force from the sheet supply deck 2 is transmitted to the pairs of convey rollers 11, 12 in the convey unit 3 through a gear train G. The gear train G includes a transmission gear 35 provided on the sheet supply deck 2, and a driven gear 36 provided on the convey unit 3. In a condition that the transmission gear 35 is engaged by the driven gear 36, when the transmission gear 35 is rotated in a clockwise direction shown by the arrow, the driving force can be transmitted to the convey unit.

As mentioned above, the rotation of the transmission gear 35 causes the driven gear 36 to rotate, thereby transmitting the driving force. In this case, the transmitted driving force F acts in a direction having a pressure angle of 20° with respect to the tangential line regarding a pitch circle of the transmission gear 35 and a pitch circle of the driven gear 36. Accordingly, the transmitted driving force F generates moment M (=L×F) acting in an anti-clockwise direction (FIG. 5) with respect to the hinge shaft 27 of the convey unit 3, thereby generating a force acting toward a direction that the convey unit 3 abuts against the side of the image forming apparatus 1.

Figure 6:
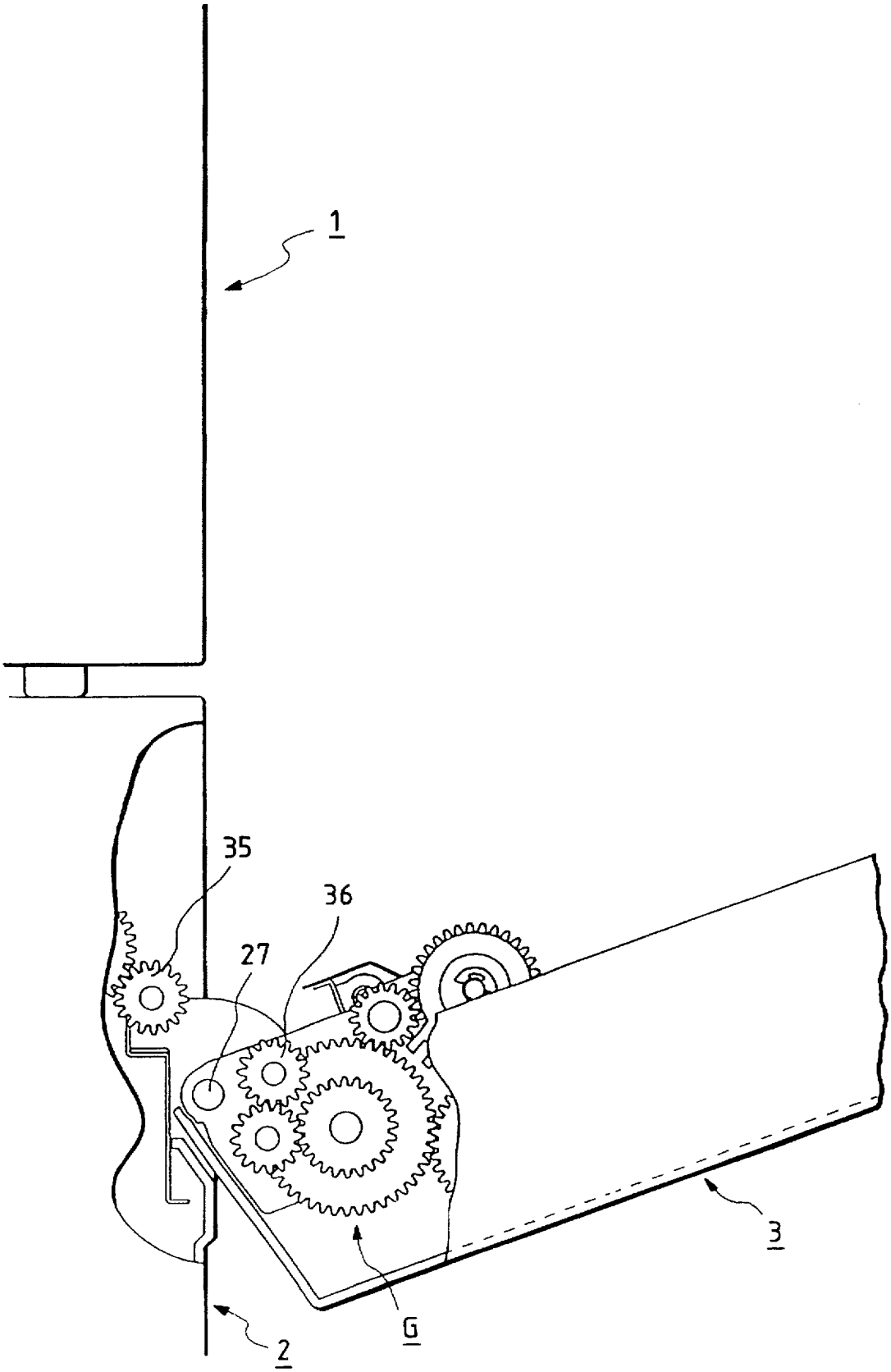
FIG. 6 is an explanatory view showing the condition that the convey unit is opened from a condition shown in FIG. 5.

Incidentally, as shown in FIG. 6, in the gear train G, when the convey unit 3 is separated from the image forming apparatus 1, the driven gear 36 is separated from the transmission gear 35 to prevent the transmitting of the driving force.

In this way, since the convey unit 3 is biased toward the image forming apparatus 1 not only by the elastic force of the torsion coil spring 28 but also by the moment M generated by the transmitted driving force, the posture of the convey unit 3 is more stabilized to ensure the smooth and positive transferring of the sheet from the convey unit to the image forming apparatus 1.

Further, when the sheet is conveyed, due to the resiliency of the sheet passing through the curved convey path in the convey unit 3, the convey unit 3 is subjected to a force to be separated from the image forming apparatus 1. The greater the resiliency of the sheet the greater the force. However, since the greater the resiliency of the sheet the greater the convey resistance against the sheet to increase the load torque of the convey unit, the driving force transmitted between the transmission gear 35 and the driven gear 36 is also increased, thereby increasing the moment M for urging the convey unit 3 against the image forming apparatus 1. Accordingly, even if the resiliency of the sheet is increased, since the moment M for urging the convey unit 3 against the side of the image forming apparatus 1 is also increased, it is possible to positively prevent the convey unit 3 from separating from the side of the image forming apparatus 1.

Incidentally, as a means for biasing the convey unit 3 toward the side of the image forming apparatus 1, as is in the illustrated embodiment, although the combination of the elastic force of the torsion coil spring 28 and the moment M generated by the transmitted driving force may be utilized, only the elastic force of the torsion coil spring 28 or the moment M generated by the transmitted driving force may be utilized. Further, the drive transmitting means may be constituted by a belt and the like, in place of the gears 35, 36.

With the arrangement as mentioned above, after the sheet supply deck 2 is disposed below the image forming apparatus 1 and the convey unit 3 is cocked at the side of the image forming apparatus 1 to communicate the main sheet convey path M of the image forming apparatus 1 with the auxiliary sheet convey path S of the convey unit 3 through the sheet receiving opening 13, the sheet stacking plate 6 of the sheet supply deck 2 is lifted. As a result, the sheet P rested on the sheet stacking plate 6 is supplied by the sheet supply roller 8. The sheet separated one by one by means of the feed roller 9 and the retard roller 10 is conveyed through the auxiliary sheet convey path S of the convey unit 3 upwardly in the vertical direction to reach the main sheet convey path M of the image forming apparatus 1 through the sheet receiving opening 13 and then is sent to the image forming portion, where the image is formed on the sheet. Thereafter, the sheet is discharged onto the discharge tray 20.

Next, a sheet supplying apparatus according to a second embodiment of the present invention will be explained with reference to FIG. 7. Incidentally, the same elements as those in the first embodiments are designated by the same reference numerals and explanation thereof will be omitted.

Figure 7:
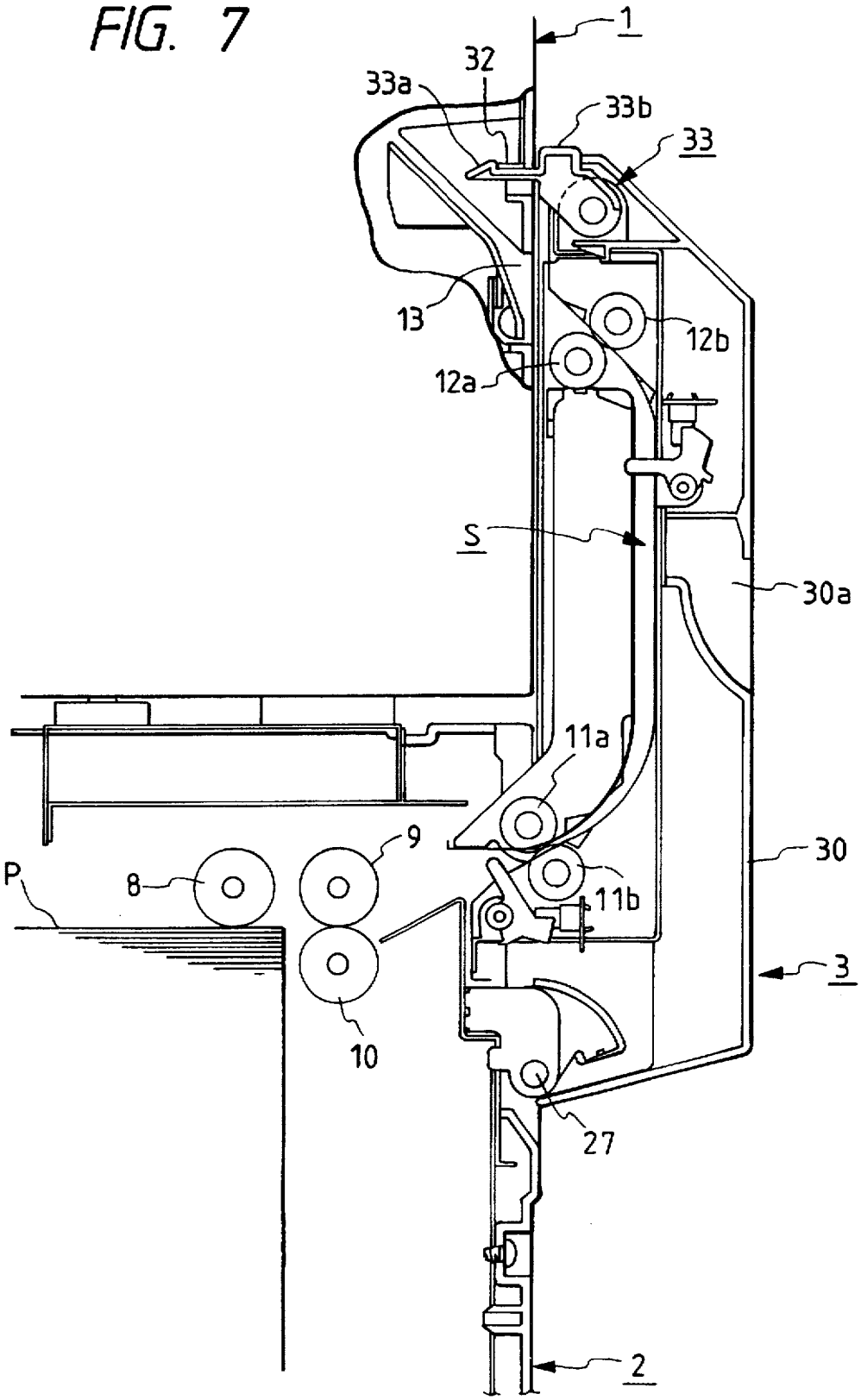
FIG. 7 is an elevational sectional view showing a second embodiment of the present invention.
Figure 8:
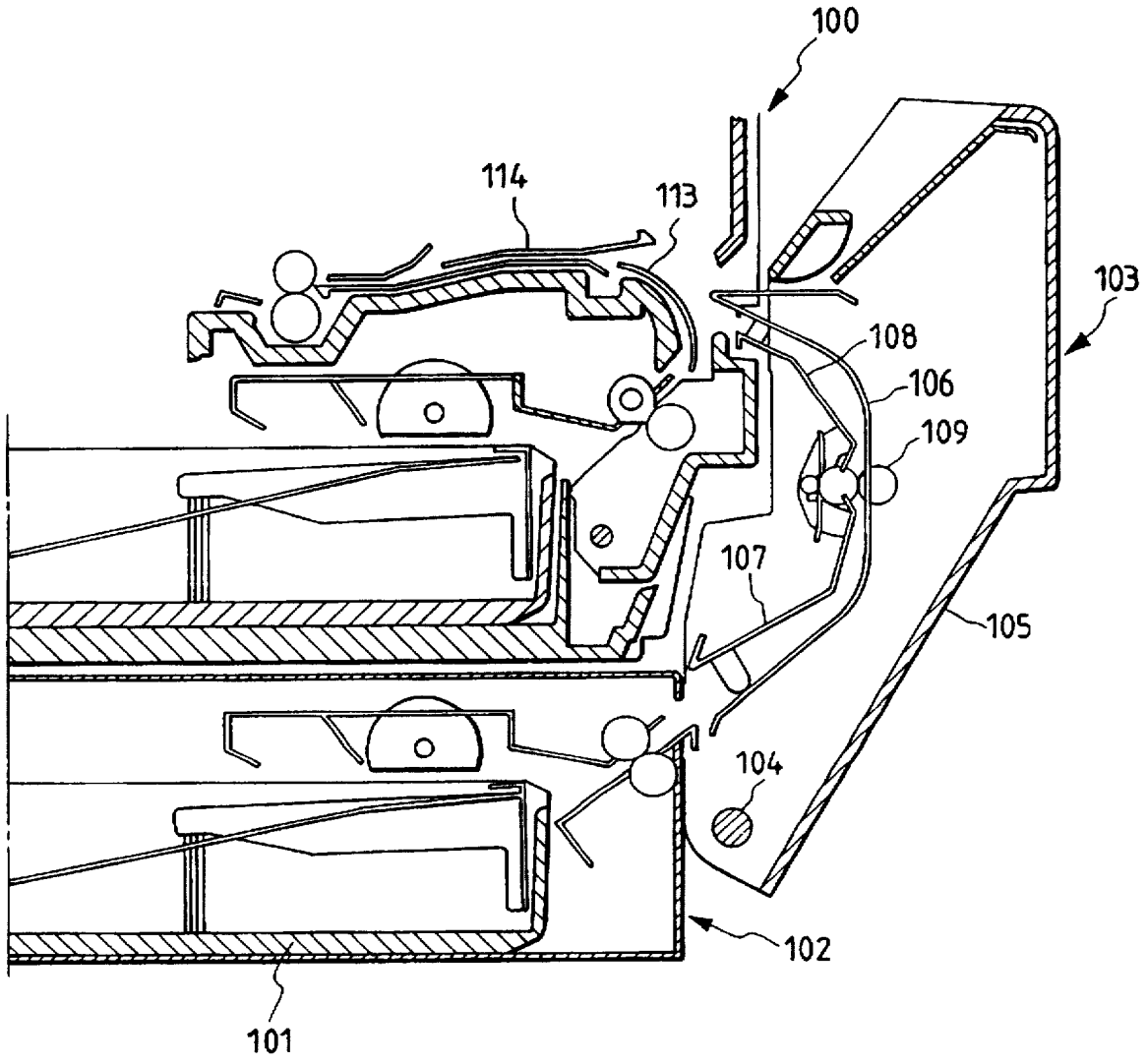
FIG. 8 PRIOR ART
FIG. 8 is an elevational sectional view showing a condition that a conventional sheet supplying apparatus is assembled to a conventional image forming apparatus.
Figure 9:
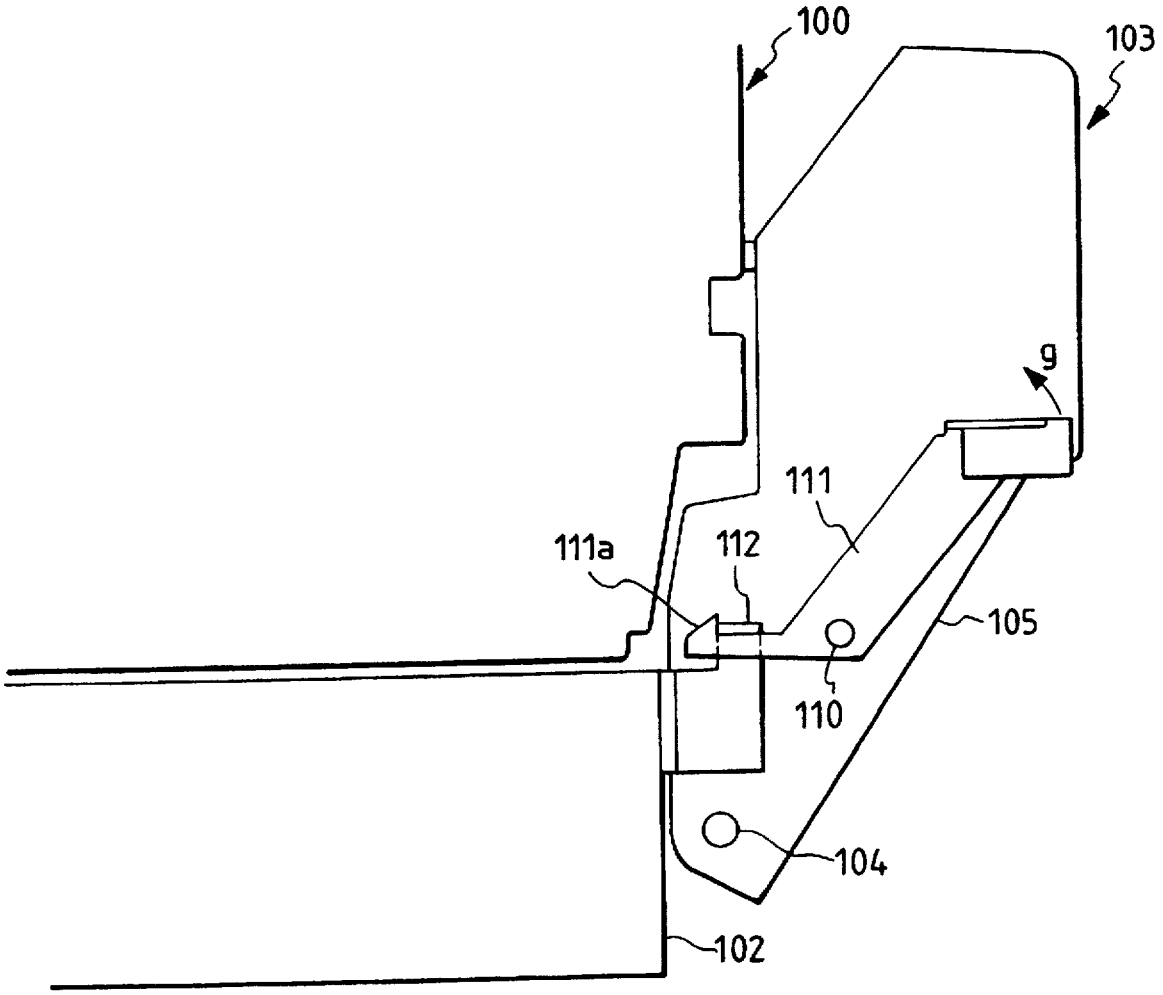
FIG. 9 PRIOR ART
FIG. 9 is a front view of the apparatuses of FIG. 8.

In FIG. 7, as is in the first embodiment, the convey unit 3 capable of supplying the sheet to the sheet receiving opening 13 formed in the side surface of the image forming apparatus 1 is provided at its upper part with a latch member 33 which can be engaged by an engagement portion 32 provided in the side surface of the image forming apparatus 1. The engagement portion 32 and the latch member 33 constitute a lock means for locking the convey unit 3 to the side surface of the image forming apparatus 1. Accordingly, by rotating the convey unit 3 around the hinge shaft 27 to cock the convey unit 3 and by engaging a pawl portion 33*a* of the latch member 33 with the engagement portion 32, the convey unit 3 is locked in the cocked condition, with the result that the auxiliary sheet path S is connected to the main sheet convey path M through the sheet receiving opening 13.

Further, by depressing an upper urging portion 33*b* of the latch member 33, the pawl portion 33*a* of the latch member 33 is released from the engagement portion 32, thereby permitting the separation of the convey unit 3 from the side of the image forming apparatus. The other construction is the same as that of the first embodiment, and the same technical advantage as that of the first embodiment can be achieved.

Incidentally, in the above-mentioned embodiments, while an example that the sheet supplying apparatus according to the present invention is applied to the electrophotograhic image forming apparatus was explained, the present invention may be applied may be applied to an ink jet recording apparatus, a heat transfer recording apparatus, a heat sensitive recording apparatus and other recording apparatuses.

As mentioned above, according to the present invention, since the convey unit is positioned with respect to the sheet receiving opening in the proximity of the sheet receiving opening of the image forming apparatus, the relative positional relation between the convey unit and the sheet receiving opening is not so greatly deviated from each other, with the result that the poor conveyance of the sheet supplied from the sheet supplying apparatus to the image forming apparatus can be greatly reduced and the reliable sheet supplying apparatus is provided.

When the convey unit is positioned with respect to the sheet receiving opening of the image forming apparatus by abutting the protruded positioning member against the side of the image forming apparatus by means of the biasing means, the convey unit can easily be set and positioned, thereby improving the assembling ability between the sheet supplying apparatus and the image forming apparatus.

Further, when the moment acting toward the direction the convey unit abuts against the image forming apparatus is generated by the transmitted driving force during the transmission of the force from the transmission gear to the driven gear, the convey unit can also be set and positioned easily, and, by further combining with the biasing means, the posture of the convey unit is further stabilized to ensure the positive and smooth sheet transfer from the convey unit to the image forming apparatus. Further, since the greater the resiliency of the sheet the greater the moment, the convey unit can be biased toward the image forming apparatus more positively.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet supplying apparatus removably connectable to an under side of an image forming apparatus to supply a sheet to said image forming apparatus, comprising:

a main body connectable to the under side of said image forming apparatus;

sheet supporting means provided within the main body of said sheet supplying apparatus for supporting a sheet;

sheet supply means for feeding out the sheet from said sheet supporting means;

a convey unit pivotally supported on the main body of said sheet supplying apparatus, said convey unit being rotatable at a lower portion thereof between a vertical closed position and an open position, said convey unit in the closed position being capable of conveying the sheet fed out by said sheet supply means through a convey path and a discharge opening provided at an upper portion of said convey unit, to a sheet receiving opening provided at a side surface of said image forming apparatus;

convey means for conveying the sheet along the convey path;

drive transmitting means for providing a drive force to drive said convey means; and positioning means for positioning said convey unit relative to the main body so that the discharge opening comes close to the sheet receiving opening, when said image forming apparatus is connected to said sheet supplying apparatus said positioning means having an abutment member disposed at the upper portion of said convey unit to be abutted against the side surface of said image forming apparatus when said image forming apparatus is connected to said sheet supplying apparatus so that the discharge opening opposes the sheet receiving opening, wherein the drive force transmitted by said drive transmitting means generates a moment on said abutment member acting in a direction that causes said abutment member to abut against the side surface of said image forming means in the closed position when said image forming apparatus is connected to said sheet supplying apparatus.

2. A sheet supplying apparatus according to claim 1, wherein said sheet supporting means includes a sheet stacking plate which can be lifted and lowered, and the sheet supply means contacts with an uppermost sheet stacked on said sheet stacking plate at a lifted position of said sheet stacking plate to feed out said uppermost sheet.

3. A sheet supplying apparatus according to claim 1, wherein said drive transmitting means has a gear train including a transmission gear provided on the main body of said sheet supplying apparatus and a driven gear provided in said convey unit, and when the rotation is transmitted from said transmission gear to said driven gear, the moment acting toward the direction that said convey unit abuts against the side surface of said image forming apparatus is generated.

4. A sheet supplying apparatus according to claim 1, wherein said convey means has rotary convey members rotated by a drive force from said drive transmitting means.

5. A sheet supplying apparatus removably connectable to an under side of an image forming apparatus to supply a sheet to said image forming apparatus, comprising:

a main body connectable to the under side of said image forming apparatus;

sheet supporting means provided within the main body of said sheet supplying apparatus for supporting a sheet;

sheet supply means for feeding out the sheet from said sheet supporting means;

a convey unit pivotally supported at a pivot point on the main body of said sheet supplying apparatus for conveying the sheet fed out by said sheet supply means through a convey path and a discharge opening provided in said convey unit, to a sheet receiving opening provided at a side surface of said image forming apparatus; and biasing means for biasing said convey unit about the pivot point toward a side surface of said image forming apparatus so that the discharge opening opposes the sheet receiving opening when said image forming apparatus is connected to said sheet supplying apparatus, wherein, when said convey unit is rotated to be separated away from the side surface of said image forming apparatus, said convey unit is maintained in a separated condition by a balance of the biasing force of said biasing means with the weight of said convey unit.

6. A sheet supplying apparatus according to claim 5, wherein said biasing means is an elastic member.

7. A sheet supplying apparatus according to claim 5, wherein said biasing means is a torsion coil spring mounted on a rotary support shaft of said convey unit.

8. A sheet supplying apparatus according to any one of claims 5 to 7, wherein, when said convey unit is rotated to be separated away from the side surface of said image forming apparatus, said convey unit is maintained in a separated condition where a biasing force of said biasing means is balanced with a weight of said convey unit.

9. A sheet supplying apparatus according to claim 8, further comprising an abutment member capable of abutting against the side surface of said image forming apparatus, when said convey unit is biased by said biasing means, and said abutment member is made of material having a function for damping shock.

10. An image forming apparatus having a sheet supplying apparatus removably connected to an under side of said image forming apparatus to supply a sheet to said image forming apparatus, comprising:

a main body of said sheet supplying apparatus connected to the under side of said image forming apparatus;

sheet supporting means provided within the main body of said sheet supplying apparatus for supporting a sheet;

sheet supply means for feeding out the sheet from said sheet supporting means;

a convey unit pivotally supported on the main body of said sheet supplying apparatus, said convey unit being rotatable at a lower portion thereof between a vertical closed position and a sloped open position, said convey unit in the closed position being capable of conveying the sheet fed out by said sheet supply means through a convey path and a discharge opening provided at an upper portion of said convey unit, to a sheet receiving opening provided at a side surface of said image forming apparatus;

convey means for conveying the sheet along the convey path;

drive transmitting means for providing a drive force to drive said convey means; and positioning means for positioning said convey unit relative to the main body so that the discharge opening comes close to the sheet receiving opening, said positioning means having an abutment member disposed at the upper portion of said convey unit to be abutted against the side surface of said image forming apparatus so that the discharge opening opposes the sheet receiving opening, wherein the drive force transmitted by said drive transmitting means generates a moment on said abutment member acting in a direction that causes said abutment member to abut against the side surface of said image forming means in the closed position.

11. An image forming apparatus having a sheet supplying apparatus removably connected to an under side of said image forming apparatus to supply a sheet to said image forming apparatus, comprising:

a main body of said sheet supplying apparatus connected to the under side of said image forming apparatus;

sheet supporting means provided within the main body of said sheet supplying apparatus for supporting a sheet;

sheet supply means for feeding out the sheet from said sheet supporting means;

a convey unit pivotally supported on the main body of said sheet supplying apparatus for conveying the sheet fed out by said sheet supply means through a convey path and a discharge opening provided in said convey unit, to a sheet receiving opening provided at a side surface of said image forming apparatus; and biasing means for biasing said convey unit about the pivoted point toward a side surface of said image forming apparatus so that the discharge opening opposes the sheet receiving opening, wherein, when said convey unit is rotated to be separated away from the side surface of said image forming apparatus, said convey unit is maintained in a separated condition by a balance of the biasing force of said biasing means with the weight of said convey unit.

* * * * *

UNITED STATES PATENT AND TRADEMARK OFFICE

CERTIFICATE OF CORRECTION

PATENT NO. : 5,765,826

DATED : June 16, 1998

INVENTOR(S) : YUZO ISODA, ET AL.

It is certified that error appears in the above-identified patent and that said Letters Patent is hereby corrected as shown below:

On the title page, item [75],

"Jun Saito;" should read --Jun Saito,--.

Column 1

Line 15, "Processing speed," should read --Recently, processing speed--.
Line 30, "as" should read --as an--.
Line 34, "as" should read --as an--.
Line 35, "convey" should read --conveying--.

Column 2

Line 45, "support" should read --support a--.
Line 58, "the" should be deleted.

Column 3

Line 47, "6.are" should read --6 are--.

UNITED STATES PATENT AND TRADEMARK OFFICE

CERTIFICATE OF CORRECTION

PATENT NO. : 5,765,826

DATED : June 16, 1998

INVENTOR(S) : YUZO ISODA, ET AL.

It is certified that error appears in the above-identified patent and that said Letters Patent is hereby corrected as shown below:

Column 4

Line 13, "is" should read --are--.

Column 5

Line 9, "disposed.at" should read --disposed at--.

Column 7

Line 18, "may be applied" (second occurrence) should be deleted.

Column 8

Line 18, "apparatus" should read --apparatus,--.
Line 21, "apparatus" should read --apparatus,--.
Line 29, "position" should read --position,--.

Signed and Sealed this

Sixteenth Day of February, 1999

*Attest:*

*Attesting Officer*

*Acting Commissioner of Patents and Trademarks*